US007661904B2

(12) United States Patent
Maggiacomo

(10) Patent No.: US 7,661,904 B2
(45) Date of Patent: Feb. 16, 2010

(54) WATER CONSERVATION AND DISTRIBUTION SYSTEM

(76) Inventor: Salvatore Maggiacomo, 1518 W. Bogie Dr., Tampa, FL (US) 33612-7327

( * ) Notice: Subject to any disclaimer, the term of this patent is extended or adjusted under 35 U.S.C. 154(b) by 0 days.

(21) Appl. No.: 12/152,237

(22) Filed: May 13, 2008

(65) Prior Publication Data

US 2009/0285632 A1 Nov. 19, 2009

(51) Int. Cl.
*E02B 11/00* (2006.01)
*E02B 13/00* (2006.01)

(52) U.S. Cl. ..... 405/43; 405/52; 52/169.5

(58) Field of Classification Search ..... 405/36, 405/38–41, 43–45, 49, 51–53, 55; 52/169.5
See application file for complete search history.

(56) References Cited

U.S. PATENT DOCUMENTS

| | | | | | |
|---|---|---|---|---|---|
| 1,529,019 | A | * | 3/1925 | Evans | 137/592 |
| 3,662,918 | A | * | 5/1972 | Crawford et al. | 210/532.2 |
| 4,330,222 | A | | 5/1982 | Klein | |
| 4,824,287 | A | * | 4/1989 | Tracy | 405/36 |
| 5,234,286 | A | | 8/1993 | Wagner | |
| 5,735,304 | A | * | 4/1998 | Chumley | 137/15.01 |
| 5,810,510 | A | | 9/1998 | Urriola | |
| 5,836,815 | A | * | 11/1998 | Jennemann | 454/341 |
| 5,988,188 | A | * | 11/1999 | Born | 134/22.11 |
| 6,270,661 | B1 | | 8/2001 | Jowell | |
| 7,025,076 | B2 | | 4/2006 | Zimmerman et al. | |
| 7,207,748 | B1 | | 4/2007 | Urban | |
| 2006/0127185 | A1 | | 6/2006 | Fauteux | |
| 2006/0169320 | A1 | | 8/2006 | Zimmerman et al. | |

FOREIGN PATENT DOCUMENTS

| | | |
|---|---|---|
| JP | 401182422 | 7/1989 |

* cited by examiner

*Primary Examiner*—Sunil Singh
(74) *Attorney, Agent, or Firm*—Edward Dutkiewicz

(57) ABSTRACT

Rainwater collected from roof gutters is poured into the vertical portion of an "ell" shaped perforated drainage pipe. The horizontal leaching pipe portion of the drainage pipe discharges the rainwater into a catch basin. Water from the catch basin flows into another perforated leaching pipe that is set in the bottom of a trench. In turn, the lower part of the trench is filled with crushed rock to a height of about three quarters of the trench depth. A water impermeable barrier of asphalt shingles or thirty pound asphalt roofing felt is placed over the top of the crushed rock and the balance of the trench is filled with soil up to the ground level.

12 Claims, 2 Drawing Sheets

Figure 1:
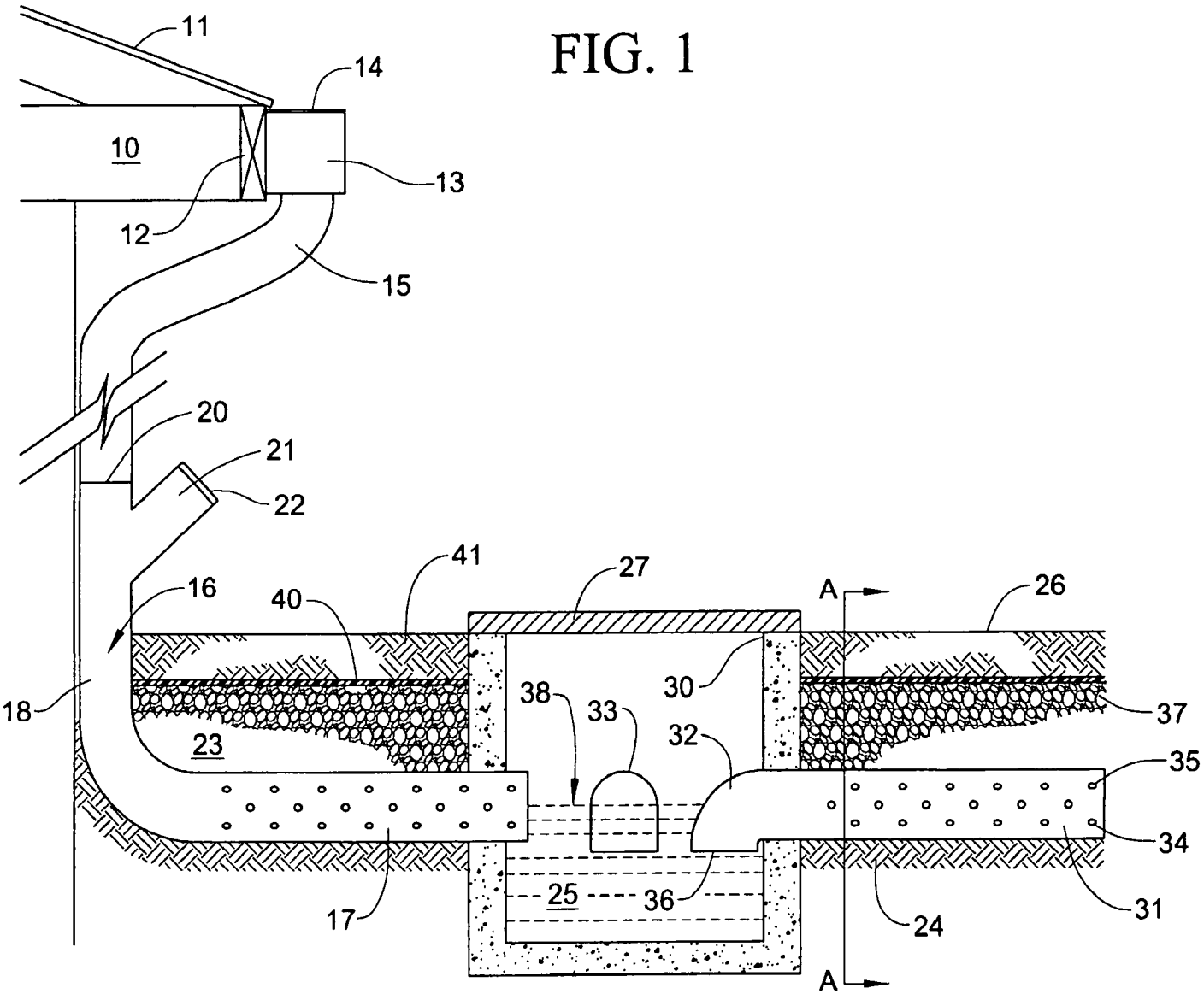

FIG. 2-A-A
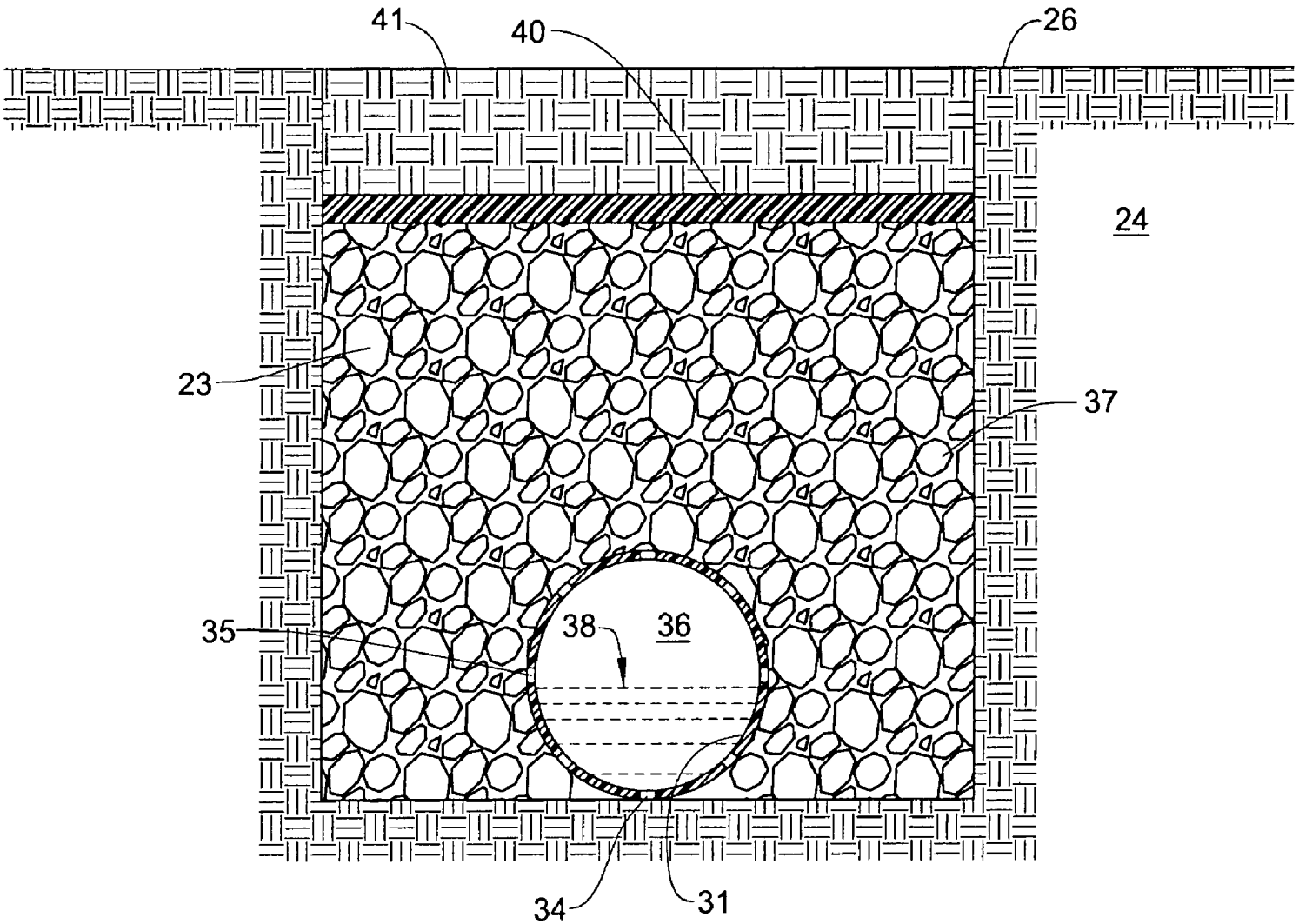

WATER CONSERVATION AND DISTRIBUTION SYSTEM

CROSS-REFERENCES TO RELATED APPLICATIONS

None

STATEMENT REGARDING FEDERALLY SPONSORED RESEARCH OR DEVELOPMENT

None

JOINT RESEARCH AGREEMENT PARTIES

None

REFERENCE TO "SEQUENCE LISTING"

None

BACKGROUND OF THE INVENTION

This invention relates to a water conservation and distribution system and more particularly to a method and apparatus for burying a perforated leaching pipe in a trench, the pipe being covered with crushed rock to a level below that of the ground surface, a layer of thirty pound asphalt roofing felt water barrier interposed between the crushed rock and a further layer of soil that completes filling the trench to the ground level, and the like.

BACKGROUND OF THE PRIOR ART

Water and rainwater in particular present both problems and opportunities. These rainwater problems include puddles, stagnation, flooding, and waste through evaporation. Plant irrigation, water conservation and acquifer replenishment, however, are among the more important benefits provided by rainwater. Accordingly, there is a need to develop a technique that will reduce to a great extent (if not completely ellminate) these problems and take advantage of the many benefits that rainwater has to offer. Naturally, in addition to the foregoing, a fully acceptable technique also must satisfy the usual engineering requirements of low cost, durability, minimal maintenance, inspection with little difficulty, adaptability to a wide range of terrain features, and the potential for system expansion.

Storm sewers, for example, although offering a general solution to the flooding problem, fail to take advantage of rainwater's benefits because the water collected in the sewer system usually is not conserved for public use, but is channeled into a river, a lake or the ocean. Other proposals have been advanced in attempts to overcome these problems and to take advantage of the opportunities inherent in rainwater. Illustratively, one proposal suggests filling a trench about half way to the ground surface with crushed rock. A pipe with drain holes is placed in the void space above the crushed rock to enable water in the pipe to percolate through the crushed rock and into the soil. The void space above the perforated pipe then is filled with more crushed rock and a water impermeable cover is placed over the trench at the ground level. The cover deflects any water from the pipe that is jetting upwardly back down through the crushed rock and into the soil. The cover also blocks rainwater falling on the cover from flowing into the trench. This proposal, however, is unsatisfactory for a number of reasons. Primarily, the water impermeable cover at the top of the trench causes that rain which falls on the cover to flow over the surface of the ground and onto the surrounding terrain, thereby aggravating the problem of undesirable puddling. Plant growth over the surface area occupied by the ground level cover, moreover, is not possible.

Consequently, there is a need for a better water conservation and distribution system.

BRIEF DESCRIPTION OF THE INVENTION

These and other difficulties that have characterized the prior art are overcome to a great extent through the practice of the invention. For example, a particular embodiment of the invention concentrates rainwater from roof gutters and the like into perforated leaching pipes that are laid in the bottom of a trench. A layer of crushed rock is deposited over the leaching pipe and partially fills the trench to about three quarters of the trench depth. Asphalt shingles, asphalt roofing felt or some other suitable water-impermeable cover, is placed over the top of the crushed rock and the balance of the trench above cover is filled to ground level with soil.

Thus not only do the shingles protect the perforations in the leaching pipes from filling with dirt, but also rainwater falling on the trench seeps into the soil over the covering, thereby flowing from the covering into the surrounding soil without pouring over the surface of the ground to form puddles. The soil over the covering also provides at least a limited opportunity for further cultivation. Water percolating through the perforations in the leaching pipe, moreover, is conserved because it seeps through the soil below the pipe to recharge an acquifer, for instance, and also to provide water for irrigation.

As a result, the practice of the invention not only avoids the waste and other undesirable features of prior art systems, but also enables better advantage to be taken of the beneficial potential inherent in rainwater. These and other features of the invention will be understood more clearly through the following detailed description of a preferred embodiment of the invention when taken with the figures of the accompanying drawing. The scope of the invention, however, is limited only through the claims appended hereto.

BRIEF SUMMARY OF THE INVENTION

FIG. 1 is a longitudinal elevation of a typical embodiment of the invention in partial section; and FIG. 2 is a transverse section of the embodiment of the invention shown in FIG. 1 taken along the plane A-A of FIG. 1 and viewed in the direction of the arrows.

DETAILED DESCRIPTION OF A PREFERRED EMBODIMENT

As best illustrated in FIG. 1, a building 10 has a peaked roof 11, of which only a portion is shown. The roof 11 slopes downward toward a molding 12 that supports a roof gutter 13, the open top of the gutter 13 being covered by a gutter filter 14. Rain (not shown in the drawing) falling on the roof 11 flows down the roof 11, through the filter 14 and collects in the gutter 13. A downspout 15 enables the collected water in the gutter to flow down into a drainage pipe 16.

In accordance with a feature of the invention, the drainage pipe 16, preferably of polyvinylchloride plastic (PVC), or the like, is formed in the shape of an "ell" with a vertical portion 18. The "ell" shape permits rainwater flowing vertically from the downspout 15 and into the vertical portion 18 of the drainage pipe 16 to flow in a horizontal direction in leaching pipe horizontal portion 17, also referred herein to as the perforated inflow pipe. The inflow pipe has a perforated portion. As can be seen in FIG. 1, the horizontal inflow pipe has a plurality of perforations there in. The vertical portion 18 of the drainage pipe 16 also has a joint 20 with the downspout 15 as shown in FIG. 1, and a short drainage pipe inspection and maintenance portion 21 that intersects interior of the drainage pipe 16 near the joint 20 to form a "Y" with an angle of about 45° relative to the vertical portion 18 of the drainage pipe 16. The pipe inspection portion 21, moreover, is provide with a removable plug 22 that covers the otherwise open end of the inspection and maintenance pipe portion 21. As can be seen in FIG. 1, the inflow pipe has a plurality of perforations located before the inflow pipe reaches a catch basin. The catch basin has a solid bottom and sides having a pipe aperture therein, as can be seen in FIG. 1. One can also see in FIG. 1 that the leaching of rainwater may begin before the water reaches the catch basin, in that some of the water may exit the inflow pipe through the perforations before the water reaches the catch basin.

As also shown in FIG. 1, the horizontal portion 17 of the drainage pipe 16 is set at the bottom of a trench 23 that has been dug in surrounding soil 24. Although dimensions may vary depending on the volume of the collected rainwater to be processed, the permeability of the soil, and the other considerations, for the precipitation, terrain, and sandy soil typical of the Tampa, Fla., region a trench width of 16 inches and a depth of 12 inches for the trench 23 have been found suitable. Further in this respect, to enable rainwater to percolate from the leaching pipe portion 17 into the surrounding soil 24 openings or perforations in the pipe portion 17 are provided in PVC pipe, as manufactured and sold, with preformed perforations that enable rainwater in the pipe to discharge from the pipe in a reasonable time.

The leaching pipe horizontal portion 17 also discharges into a rectangular catch basin 25. An illustrative depth of 18 inches below ground surface 26, a length of 18 inches and a width of about 16 inches have been found to be suitable for the catch basin 25 in the Tampa, Fla., region, although these dimensions can vary to some degree in order to match other local conditions occurring elsewhere. To cover the catch basin 25 and protect it from becoming fouled with leaves, dirt and other debris, a removable reinforced concrete slab or iron grate 27 is placed over open upper surface 30 of the catch basin 25.

A further leaching pipe 31 has a short "ell" 32 that protrudes into the interior volume of the catch basin 25 and the leaching pipe 31. Another leaching pipe "ell" 33 also protrudes into the internal volume of the catch basin 25 as a second pipe in a part of an array of buried leaching pipes (not shown) that comprise an entire rainwater distribution system. The second pipe is also referred to herein as the perforated outflow pipe, in that water arrives to the catch basin from the inflow pipe, and leaves the catch basis through the perforated outflow pipe.

Turning once more to the leaching pipe 31 and as best shown in FIG. 2, the pipe 31 as mentioned above has perforations of which perforations 34 and 35 are typical. These perforations permit fluid communication between interior 36 of the pipe 31, and gravel, aggregate, crushed rock 37 or other suitable material and the soil 24 in which the trench was dug. In this respect, it has been found that ¾ inch crushed lime rock is satisfactory in the Tampa Fla., region for the purposes of the invention. A smaller size aggregate, moreover, is likely to plug the perforations in the pipe 31. As illustrated, the trench 23 is filled to about three quarters of its depth with the crushed rock 37. Again, the depth of the crushed rock 37 may vary to a limited extent depending on the degree to which the soil and precipitation conditions in which the distribution system is installed vary from those of the Tampa, Fla., region.

A water impermeable barrier or layer 40 of thirty pound asphalt roofing felt paper, asphalt shingles, plastic sheeting or other suitable material is placed over the top of the gravel 37. The balance of the trench 23 then is filled up to the ground surface 26 with a final layer of soil 41.

In operation, the trench 23 is dug and the catch basin 25 (FIG. 1) is installed establishing fluid continuity between the discharge from the leaching pipe horizontal portion 17, the water level 38 in the internal volume of the catch basin 25 and the interior 36 (FIG. 2) of the leaching pipe 31 through the "ell" 32 (FIG. 1). The leaching pipe "ell" 33 also establishes fluid communication with the catch basin 25 for a trench and leaching pipe arrangement (not shown in the Drawing) similar to that which is described above in connection with the leaching pipe 31. In this way, by replicating the structure described for the leaching pipe 31 several times an extensive rainwater distribution system can be provided. It has been found, for example, that as much as 80 feet of underground piping can be serviced through the system being described.

Rain, falling on the roof 11, flows through the gutter 13 and downspout 15 into the vertical drainage pipe portion 18. As previously described, this captured rainwater flows through the horizontal leaching pipe portion 17, some of the rainwater in the portion 17 percolating into the trench 23 and the soil 24 and the balance of the rainwater flowing into the catch basin 25. As the catch basin 25 fills to an illustrative volume as suggested by the water level 38, rainwater flows through the "ell" 32 and into the leaching pipe 31. Air in the pipe 31 is displaced through, for example, the perforations 34 and 35 permitting the rainwater to percolate through the perforations 34 and 35 into the crushed rock 37 and thence into the soil 24 surrounding the trench 23. Thus, the rainwater seeping into the soil 24 from the trench 23 can eventually recharge an acquifer and irrigate the soil.

The rain also falls on the soil 41 that is placed over the water impermeable barrier 40. This rainwater, however, seeps directly into the soil 41 over the trench 23 and does not form undesirable puddles and the like, but flows away from the barrier and directly into the surrounding soil 24, thereby providing a further rainwater saving. It is believed, for instance, that about 15% of the rainwater entrapped within the system will irrigate the surrounding plant life while the balance of the rainwater will provide acquifer replenishment.

To examine the condition of the distribution system, the plug 22 is removed from the drainage pipe inspection and maintenance portion 21 and any appropriate optical examination technique, e.g. mirrors or fibre optic apparatus can be introduced into the system for direct observation. To examine the integrity of the leaching pipe 31, moreover, the iron grate 27 over the catch basin 25 is opened and optical inspection apparatus is inserted into the interior 36 of the pipe 31 through the "ell" 32. After examination is complete, the optical inspection apparatus is withdrawn and the plug 22 and the iron grate 27, respectively, are replaced. Further in this regard, it may be desirable to remove from the catch basin any debris that collected there before replacing the iron grate 27.

Consequently, there is provided in accordance with the principles of the invention a significantly improved water conservation and distribution system that overcomes many of the disadvantages that have characterized the prior art.

What is claimed is:

1. A waste conservation and soil irrigation system comprising a building having a rain downspout, a perforated inflow pipe fluidly coupled to the rain downspout and a catch basin fluidly coupled to the perforated inflow pipe and a perforated outflow pipe fluidly coupled to the catch basin, a trench having a bottom being formed in the soil, the perforated inflow pipe being at the bottom of said trench, the catch basin having a solid bottom, the catch basin being located between the perforated inflow pipe and the perforated outflow pipe and the catch basin coupling the perforated inflow pipe and the perforated outflow pipe, the perforated outflow pipe also being located at the bottom of the trench, crushed rock partly filling said trench, said crushed rock at least covering said perforated inflow pipe and said outflow pipe, a water impermeable barrier over said crushed rock, and soil over said barrier and filling the balance of said trench.

2. A system according to claim 1 wherein said crushed rock fills about three quarters of the depth of said trench.

3. A system according to claim 1 wherein said impermeable barrier further comprises asphalt shingles.

4. A system according to claim 1 wherein said impermeable barrier further comprises asphalt roofing felt.

5. A system according to claim 4 wherein said trench is about sixteen inches wide.

6. A system according to claim 1 wherein said trench is about one foot deep.

7. A system according to claim 1 further comprising the inflow perforated pipe and the outflow perforated pipe each having a bottom, with the bottom of each pipe being in direct contact with the bottom of the trench, with the crushed stone being located above the bottom of each perforated pipe.

8. A system according to claim 7 wherein said catch basin is about eighteen inches long, about sixteen inches wide and about eighteen inches in height.

9. A system according to claim 7 further comprising an ell on the inflow perforated pipe for establishing said fluid communication between the inflow perforated pipe and said catch basin.

10. A system according to claim 7 wherein said catch basin further comprises a movable covering over said catch basin.

11. A system according to claim 7 further comprising a vertical drainable pipe portion in fluid communication with said perforated inflow pipe and a leaching pipe inspection and maintenance portion intersecting said vertical drainable pipe portion.

12. A system according to claim 1 where said crushed rock further comprises aggregate.

* * * * *